US005984451A

United States Patent [19]

Muraki

[11] Patent Number: 5,984,451

[45] Date of Patent: Nov. 16, 1999

[54] INK JET HEAD CAPPING DEVICE AND INK JET RECORDER INCLUDING SAME

[75] Inventor: Motohito Muraki, Nagoya, Japan

[73] Assignee: Brother Kogyo Kabushiki Kaisha, Nagoya, Japan

[21] Appl. No.: 08/892,727

[22] Filed: Jul. 15, 1997

[30] Foreign Application Priority Data

Jul. 16, 1996 [JP] Japan ..... 8-186402

[51] Int. Cl.[6] ..... B41J 2/165

[52] U.S. Cl. ..... 347/29; 347/30

[58] Field of Search ..... 347/29, 30, 31, 347/32

[56] References Cited

U.S. PATENT DOCUMENTS 5,835,109 11/1998 Uchida ..... 347/24

FOREIGN PATENT DOCUMENTS 61-188156 8/1986 Japan .
62-113556 5/1987 Japan .
4-14461 1/1992 Japan .
5-77433 3/1993 Japan .
5-104731 4/1993 Japan .
5-246038 9/1993 Japan .
6-8457 1/1994 Japan .
6-155753 6/1994 Japan .

*Primary Examiner*—N. Le
*Assistant Examiner*—Shih-wen Hsieh
*Attorney, Agent, or Firm*—Oliff & Berridge, PLC

[57] ABSTRACT

An ink jet printer includes a capping device. The device includes a cap having a brim for covering the ink jet surface of an ink jet head. The device also includes a holder for holding the cap. When held by the holder, the cap deforms elastically in such a manner that a protrusion protrudes the middle of the cap brim toward the jet surface. The cap has a cavity formed in it. When the brim of the cap held by the holder is pressed against the jet surface, the cap deforms elastically in such a manner that the brim covers the surface completely. The elastic deformation collapses the cavity, thereby reducing the force for pressing the cap against the head.

25 Claims, 7 Drawing Sheets

INK JET HEAD CAPPING DEVICE AND INK JET RECORDER INCLUDING SAME

BACKGROUND OF THE INVENTION

1. Field of the Invention

The present invention relates to a capping device for an ink jet head recovery apparatus and an ink jet recorder including such an apparatus.

2. Description of the Related Art

FIG. 7 of the accompanying drawings shows the capping device of a conventional recovery apparatus for an ink jet head. The capping device can prevent the jet nozzle of the head 30 from drying and/or foreign matter from entering the nozzle. The device includes a cap 32 having a brim 33 for close contact with the vertical front surface 31 of the head 30. The cap brim 33 is rectangular, and has longer, substantially vertical sides and shorter horizontal sides. The longer sides of the brim 33 are narrow so as to be deformed easily when the cap 32 is pressed against the head surface 31. In order that the brim 33 may contact more closely with the head surface 31, the height H of the cap 32 at the middle of the longer sides of the brim is higher than its height h at their both ends. Such a cap is disclosed in Japanese Patent Laid-Open No. 6-155753.

The cap 32 can also operate for the recovery apparatus for cleaning the head 30 so as to prevent it from being clogged with ink or to remove clogging ink, or for pumping ink into the head 30 when the ink cartridge is replaced. The middle of the cap 32 is higher not only to improve the closeness of contact of the cap with the head surface 31, but also to reduce the amount of air entrained when the cap is separated from the head 30.

In order to bring the cap 32 into close contact with the head surface 31, as shown by two-dot chain lines in FIG. 7, there is a need of great compressive force for pressing the cap until the cap brim 33 becomes flat. If the close contact with great compressive force is done frequently, the cap 32 may be deformed, so that its accuracy of close contact may become low.

SUMMARY OF THE INVENTION

It is a primary object of the present invention to provide a capping device including a cap which can, with smaller compressive force, contact closely with a jet head surface, without lowering the accuracy of close contact of the cap with the nozzle surface.

It is another object of the invention to provide an ink jet recorder including such a capping device.

In accordance with a first aspect of the invention, an ink jet head capping device is provided, which comprises a cap and a holder for holding the cap. The cap has a brim for covering the ink jet surface of an ink jet head. The cap is made of elastic material which can elastically deform in such a manner that, when the cap is held by the holder, the middle of the cap brim protrudes toward the jet surface and, when the brim of the cap held by the holder is pressed against the jet surface, the cap can cover the jet surface completely.

Thus, when held by the holder, the cap is deformed elastically in such a manner that the middle of the cap brim is protruded toward the ink jet surface. Accordingly, when the cap and the ink jet head approach relatively, the protruded middle of the cap brim first comes in contact with the jet surface. When the cap held by the holder is pressed against the jet surface, the cap brim is deformed elastically so as to completely cover the jet surface, preventing the surface from drying.

The cap may have a cavity formed therein, which can reduce the pressing force needed in order for the cap to completely cover the ink jet surface. The cap may be formed in a shape of groove.

When the ink jet head and the cap start to move relatively away from each other, the elasticity of the cap restores the middle of the cap brim to the shape protruding toward the ink jet surface. Accordingly, the cap brim starts to be released from the jet surface gradually from both (upper and lower) ends of the cap. This prevents air from being entrained when the cap brim is released from the jet surface.

The ink jet head may have a row of nozzles formed therein with their front ends in the ink jet surface. The cap may be a long member extending along the nozzle row, and may have a cavity formed therein at least in the longitudinal middle thereof. The holder may have a holding surface for contact with the back of the cap, and an engaging part for such engagement with the cap that the cap back is in contact with the holding surface. Between the cap back and the holding surface, a protrusion may be provided for making the longitudinal middle of the cap back higher than the longitudinal end portions of the cap back when the cap back is in contact with the holding surface.

In such a case, when the cap is held on the holder by the engaging part of the holder, it can elastically deform in such a manner that the contact of the protrusion and the cap back or the holding surface protrudes the longitudinal middle of the cap brim forward and, when the brim of the cap held by the holder is pressed against the jet surface, the collapse of the cavity causes the brim to completely cover the jet surface.

The protrusion may be formed integrally with either the cap or the holder. In either case, when the cap is held by the holder in such a manner that the cap back is in contact with the holding surface of the holder, the protrusion can make the longitudinal middle of the cap back higher than the longitudinal end portions of the cap back.

The protrusion may be comprised of a pair of protrusions formed on both lateral ends of the cap back. The cavity may be comprised of by a pair of cavities formed in both lateral ends of the cap. In such a case, the longitudinal middle of the cap brim protrudes to substantially equal height at the lateral ends. This can improve the closeness of contact of the cap with the ink jet surface.

The cavity or cavities may be filled with urethane, foamed material or other contractible material. The coefficient of contraction and/or the elasticity of the material may be determined properly by the relation with the cap elasticity.

In accordance with a second aspect of the invention, an ink jet printer is provided. The printer comprises a carriage for moving along a surface of a printing sheet, an ink jet head carried by the carriage, and a capping device. The capping device includes a cap and a holder for holding the cap. The cap has a brim for covering the ink jet surface of the head. The cap is made of elastic material which can elastically deform in such a manner that, when the cap is held by the holder, the middle of the cap brim protrudes toward the jet surface and, when the brim of the cap held by the holder is pressed against the jet surface, the middle of the brim covers the jet surface completely.

BRIEF DESCRIPTION OF THE DRAWINGS

A preferred embodiment of the present invention is shown in the accompanying drawings, in which.

DETAILED DESCRIPTION OF THE EMBODIMENT

Figure 1:
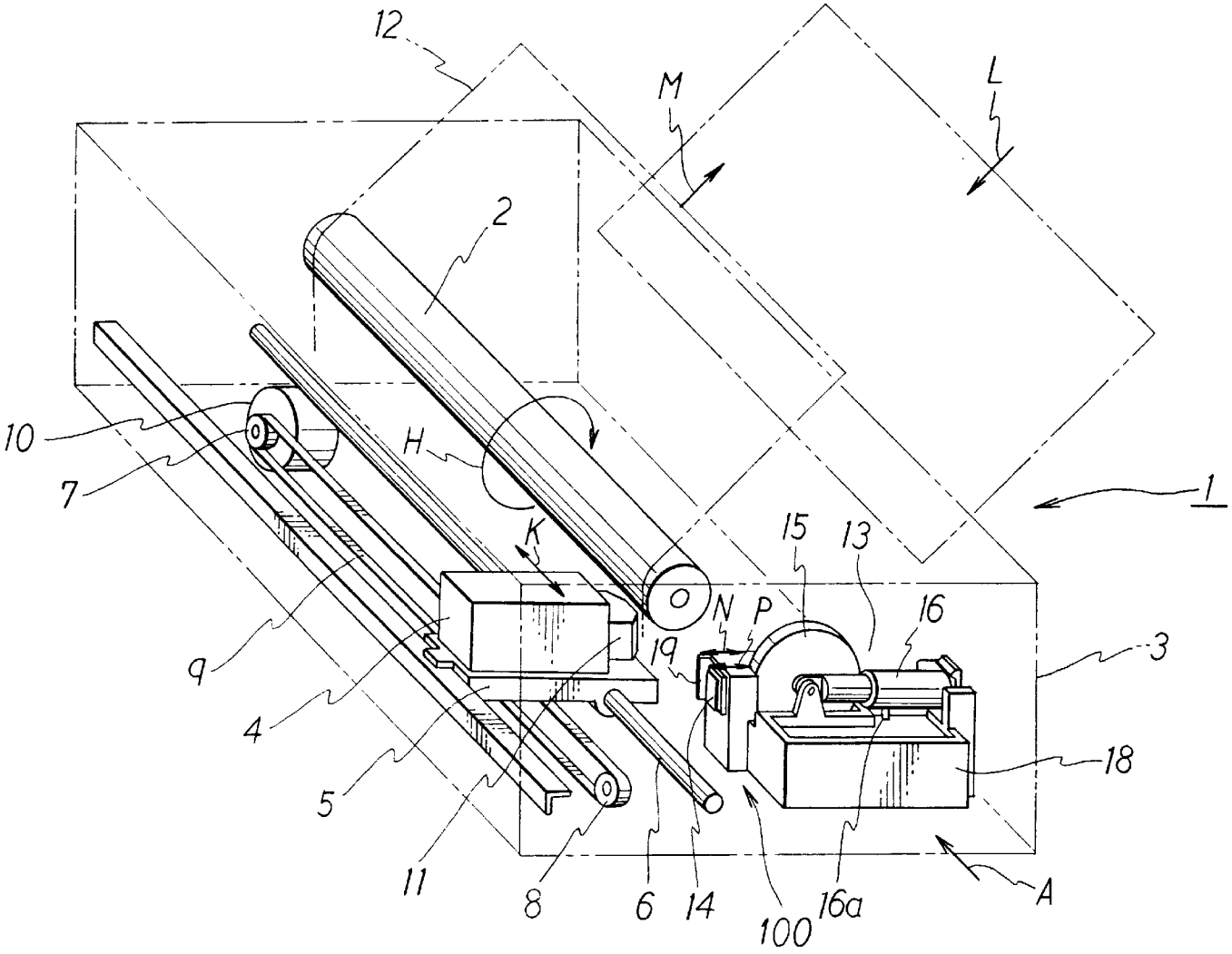
FIG. 1 is a perspective view showing the outline of an ink jet printer according to the embodiment.

With reference to FIG. 1, an ink jet printer 1 includes a frame 3 and a cylindrical platen 2. The platen 2 extends horizontally, and is supported rotatably in the direction H by a shaft (not shown) on the frame 3.

A guide rod 6 extends in parallel with the platen 2, and is fixed to the frame 3. A carriage 5 is supported slidably on the rod 6. An ink jet head unit 4 is mounted on the carriage 5 in such a manner that it faces the platen 2. A pair of pulleys 7 and 8 are supported by the frame 3. A timing belt 9 extends between the pulleys 7 and 8, and is connected to the carriage 5. A carriage drive motor 10 can rotate the pulley 7 to drive the belt 9 so that the carriage 5 moves in the directions K along the platen 2.

The head unit 4 can reciprocate within a predetermined recording range along the platen 2. The head unit 4 includes an ink jet head 11, which has a number of ink passages or channels (not shown) formed therein and a number of jet orifices (not shown) each associated with one of the passages. The passages can be supplied with ink from an ink supply unit (not shown), which may be fixed to the frame 3 or mounted on the carriage 5. Part of the wall of each of the passages is formed by a diaphragm (not shown). When the diaphragm is deformed by a drive circuit (not shown) in accordance with a command from a control unit (not shown), the pressure change resulting from the deformation ejects ink from the associated jet orifice. While the carriage 5 is moving, ink is ejected onto recording paper 12 fed between the platen 2 and head unit 4. During a stroke of the carriage 5, a line of an image is formed. After an image line is formed, the platen 2 turns to feed the paper 12 by one line, and then another image line is formed. By repeating this, it is possible to form an image on the whole paper 12. The paper 12 can be fed in the direction L through a paper feed port (not shown) behind the frame 3, and turned in the direction M by the platen 2. The turned paper 12 is discharged through a discharge port (not shown).

After recording operation as described above, the head unit 4 is returned to its non-recording or home position, where it faces a recovery apparatus 13, which is fixed to the frame 3.

The recovery apparatus 13 includes a capping device 100 and a pump 16. The capping device 100 is placed on one side of the platen 2, and includes a cap 14, which may be made of rubber. The cap 14 has a rectangular cavity formed in its front surface for covering the rectangular front surface of the head 11. The cavity has longer vertical sides and shorter horizontal sides. When the carriage 5 has, after printing operation stops, moved to its home position, where it faces the capping device 100, the cap 14 is moved by a cam 15 into liquid-tight engagement with the head 11.

As shown in FIG. 2, the suction cavity of the cap 14 is connected through a tube 17 to a pump 16, which can be operated by the cam 15. The ink remaining in the head 11 can be sucked by the pump 16 through the cavity of the cap 14 engaging with the nozzle, and through the tube 17. The sucked ink is discharged through a discharge port 16*a* into a foamed body 18 for absorbing the waste liquid.

The recovery apparatus 13 also includes a wiper, which includes a rubber blade 19. The turning of the cam 15 reciprocates the wiper blade 19 in the directions N in FIG. 1 to wipe away the ink remaining on the front end surface of the head 11 after the suction by the pump 16.

The capping device 100 and the recovery apparatus 13, which includes the capping device 100, of this embodiment will be described below in detail.

Figure 2A:
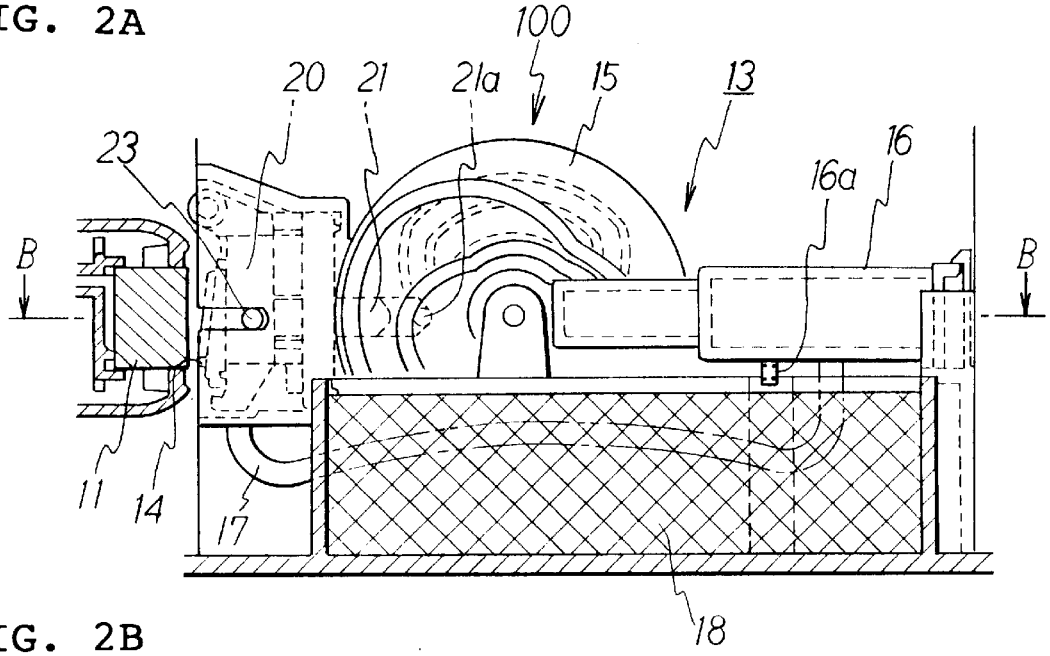
FIG. 2A is a side view partially in section of part of the printer seen in the direction A of FIG. 1, showing the ink jet head capping device and the recovery apparatus, which includes the capping device.
Figure 2B:
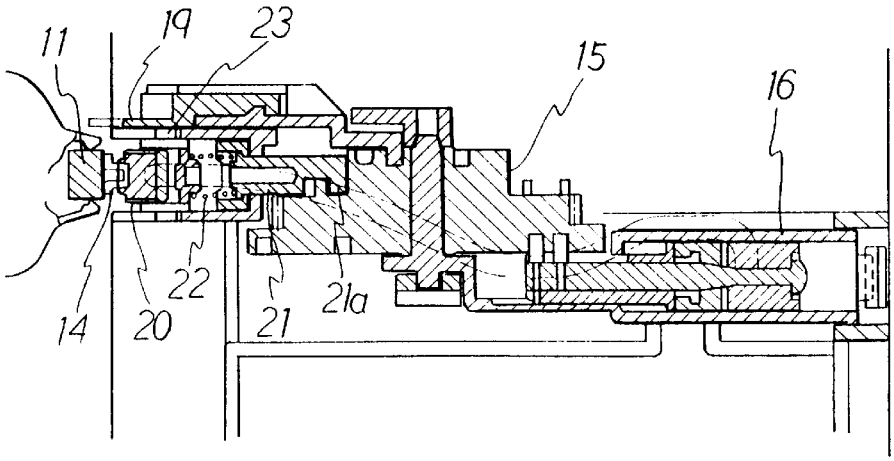
FIG. 2B is a cross section taken along line B—B of FIG. 2A.

As shown in FIGS. 2A and 2B, the cap 14 is mounted on a holder 20. The holder 20 is supported by a mover 21, and biased by a compression spring 22, which is interposed between the holder 20 and mover 21. The mover 21 is fitted with a cam follower 21*a* engaging with the cam 15.

Figure 2C:
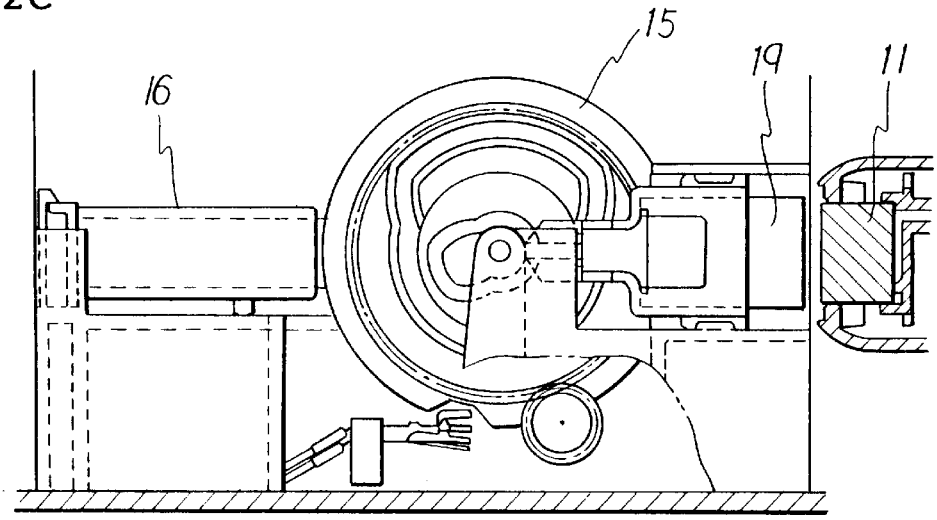
FIG. 2C is a side view partially in section of part of the printer seen in the direction opposite to the direction A of FIG. 1.

As shown in FIGS. 2B and 2C, the wiper blade 19 is located on one side of the cap 14. The cam mechanism can move the wiper blade 19 between a contact position and a retracted position relative to the head 11 so as to clean the nozzle surface after suction for recovery by the pump 16.

The operation of the cam 15 can move the mover 21 toward the head 11 so as to bring the cap 14 into close contact with the head surface. This can prevent the head surface from drying and protect the head 11 from the entrance of foreign matter. The pump 16 can operate for sucking recovery.

Figure 4A:
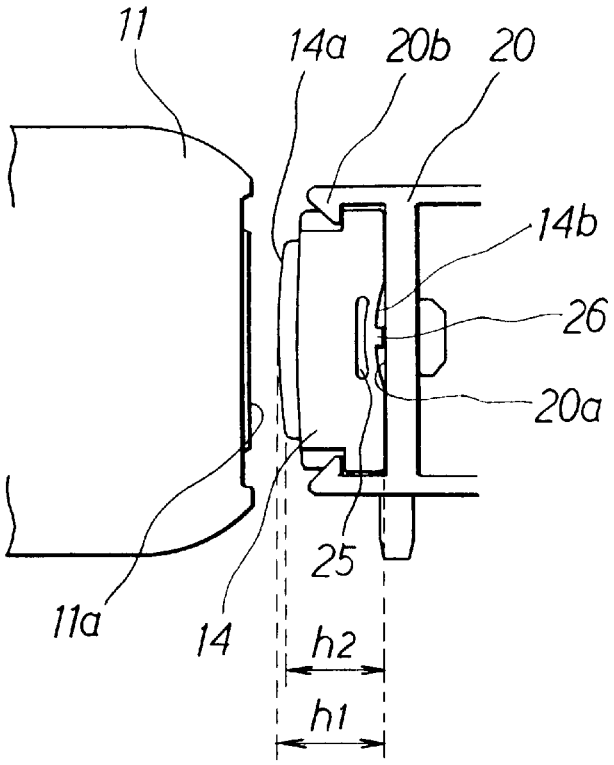
FIGS. 4A and 4B are side views showing the capping device of the embodiment in different positions relative to the jet surface of the ink jet head.

For secure protection and sucking recovery of the head surface, it is necessary to improve the closeness of contact of the cap 14 with the head surface. It is therefore preferable that the height of the brim of the cap 14 be higher at the longitudinal middle than at both end portions as shown in FIG. 4A. By thus making the middle of the cap brim higher, it is possible, not only to improve the closeness of contact, but also to reduce the amount of air entrained when the cap 14 is separated from the head 11. This is desirable for sucking recovery.

However, if the cap 14 was so formed that the middle of the cap brim was higher, there would be a need of great compressive force for bringing the cap 14 into close contact with the head surface until the brim becomes flat. After repeated close contact of such a cap with a head surface, the cap might be deformed, so that its accuracy of close contact might be lowered.

Accordingly, the cap 14 is so constructed that, when it is held by a holder, the longitudinal middle of the cap brim is made high by virtue of the elastic deformation of the cap and, when it contacts closely with the nozzle surface, its brim becomes flat likewise by virtue of the elastic deformation.

As shown in FIGS. 3A–3E, the cap 14 is formed integrally out of EPDM rubber, polyurethane, KURATON, TERATAN or other elastic material. The outward form of the cap 14 is substantially a rectangular parallelepiped with longer vertical sides and shorter horizontal sides.

Figure 3A:
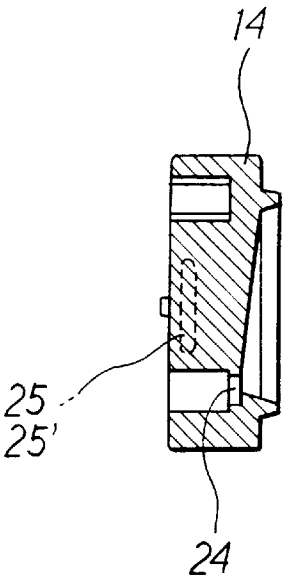
FIG. 3A is a cross section taken along line C—C of FIG. 3B of the cap of the embodiment.
Figure 3B:
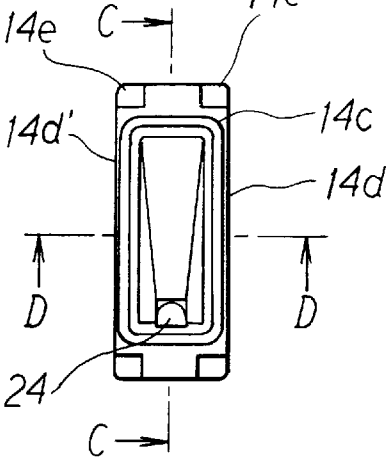
FIG. 3B is a front view of the cap.

The cap 14 includes a rectangular brim 14*c* formed on its front surface for contact with a jet surface of an ink jet head nozzle. The cap brim 14*c* defines the rectangular cavity. The front end of the brim 14*c* forms a cap surface 14*a* for contact with the jet surface (11*a*) of the ink jet head. As shown in FIGS. 3A and 3E, the brim 14*c* becomes narrower or thinner as it extends toward the front end of the brim 14*c*.

Figure 3C:
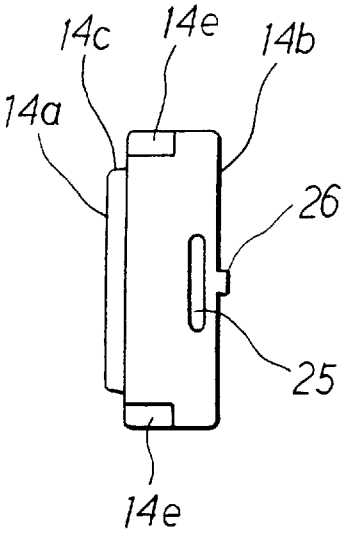
FIG. 3C is a side view of the cap.
Figure 3D:
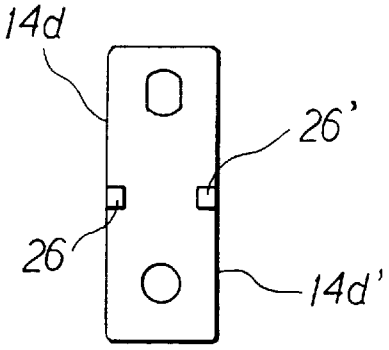
FIG. 3D is a rear view of the cap.
Figure 3E:
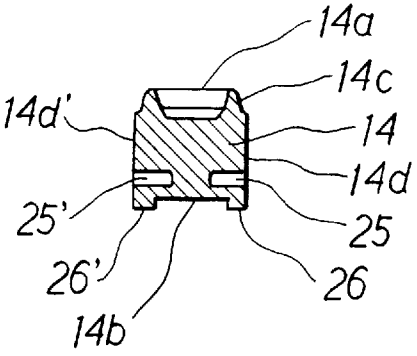
FIG. 3E is a cross section taken along line D—D of FIG. 3B.

As shown in FIGS. 3C and 3E, the cap 14 has a pair of longitudinally extending grooves or cavities 25 and 25' formed in its side surfaces 14*d* and 14*d'*, respectively. The grooves 25 and 25' are positioned in the middle of the length of the cap 14 and near the bottom or rear surface 14*b* of the cap. As shown in FIG. 3E, the grooves 25 and 25' extend laterally in parallel with the cap bottom 14*b* and in alignment with each other. The grooves 25 and 25' correspond to a cavity formed in the cap in accordance with the invention.

The cap 14 also includes a pair of protrusions 26 and 26' formed on its bottom 14*b*. The protrusions 26 and 26' are positioned in the middle of the length of the cap 14 and at both lateral ends of the cap. As best shown in FIG. 3E, the protrusions 26 and 26' are positioned near and associated with the grooves 25 and 25', respectively. The cap bottom 14*b* is substantially flat except for the protrusions 26 and 26'.

As shown in FIGS. 3B and 3C, the cap 14 has four hollows or depressions 14*e* each formed in one of the corners of its front surface. The hollows 14*e* can engage with the claws of the holder, which will be explained later.

FIG. 4A shows the cap 14 being held by the holder 20. The holder 20 has a vertical holding surface 20*a*, which is substantially straight or flat, for compressive contact with the cap bottom 14*b*. The holder 20 includes claws 20*b* for engagement with the cap hollows 14*e*. As shown in FIG. 4A, the cap 14 is fitted to the holder 20 through the claws 20*b*. This brings the cap bottom 14*b*, except for the peripheries of the protrusions 26 and 26', into close contact with the holding surface 20*a* because the protrusions protrude from the cap bottom. Because the protrusions 26 and 26' are in contact with the holding surface 20*a*, as shown in FIG. 4A, the cap 14 is so deformed that the longitudinal middle of the cap brim 14*c* protrudes toward the jet surface 11*a* of the head 11. That is to say, the horizontal height h1 of the longitudinal middle of the cap brim 14*c* (the cap surface 14*a*) from the cap bottom 14*b* is higher than the horizontal height h2 of both longitudinal ends of the brim 14*c* (the cap surface 14*a*) from the bottom.

Figure 4B:
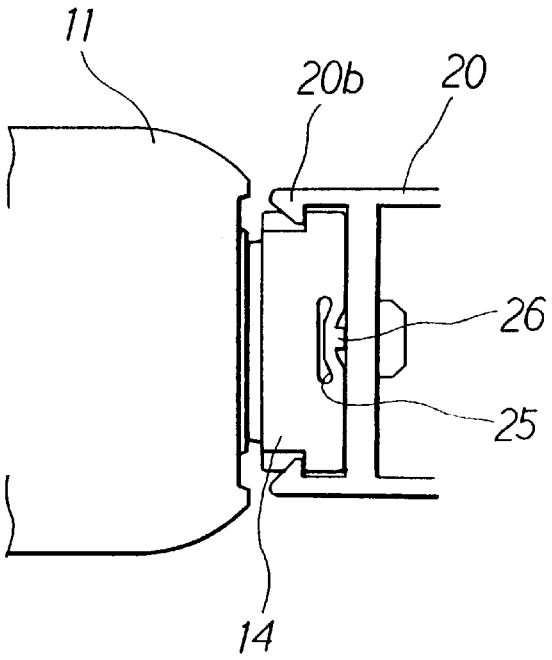

When, as shown in FIG. 4B, the deformed cap 14 held by the holder 20 is pressed against the jet surface 11*a*, the longitudinal middle of the cap brim 14*c* first comes in contact with the surface 11*a*. When the cap 14 is further pressed, the pressing force causes part of the cap bottom 14*b* to buckle into the grooves 25 and 25', which are formed near the protrusions 26 and 26', respectively. This makes the cap brim 14*c* substantially straight or flat along the vertical length of the cap 14, as shown in FIG. 4B. As a result, the cap 14 can engage with the jet surface 11*a* very closely and tightly without great pressing force applied to the cap.

FIGS. 5A–5C and 6A–6C show how the head 11 recovers by means of the capping device 100 and recovery apparatus 13, which include the cap 14 and holder 20 shown in FIGS. 3A–3E, 4A and 4B.

Figure 5A:
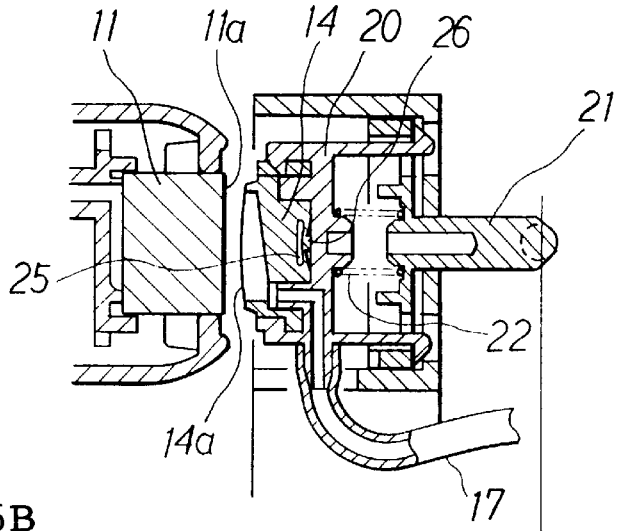
FIGS. 5A–5C are cross sections showing the capping device coming into contact with the jet surface.

When the mover 21 is in the retracted position, as shown in FIG. 5A, the brim 14*c* of the cap 14 held by the holder 20 is separate from the jet surface 11*a* of the head 11. The cap brim 14*c* (the cap surface 14*a*) is so curved that its longitudinal middle protrudes toward the jet surface 11*a*. The spring 22 so urges the holder 20 forward that the holding surface 20*a* of the holder 20 is substantially parallel with the jet surface 11*a*.

Figure 5B:
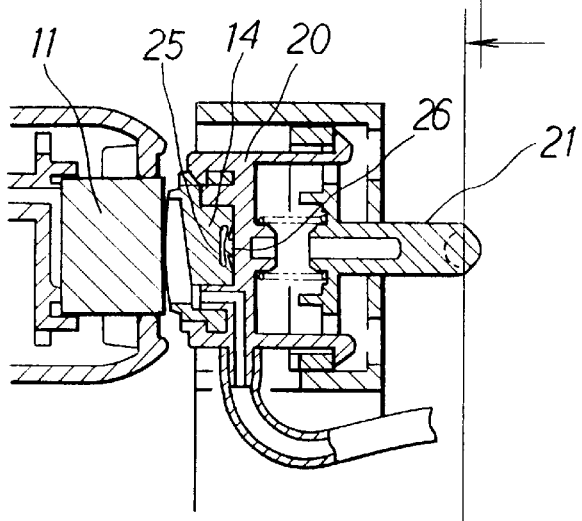

Then, the turning of the cam 15 (FIGS. 1 and 2A–2C) moves the mover 21 from the retracted position toward the jet surface 11*a*. As shown in FIG. 5B, the longitudinal middle of the cap brim 14*c* (the cap surface 14*a*) first comes in contact with the jet surface 11*a*.

Figure 5C:
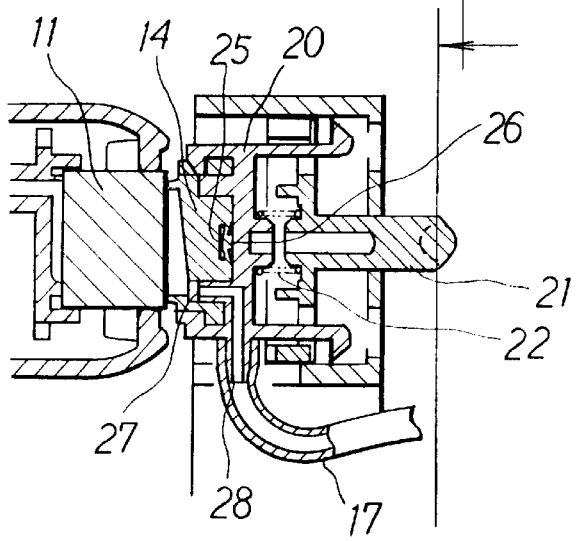

As shown in FIG. 5C, further forward movement of the mover 21 deforms the cap brim 14*c* easily through the collapse of the cap grooves 25 and 25'. This brings the brim 14*c* into close contact with the jet surface 11*a*, and makes its front end substantially straight. During the close contact, the contraction of the spring 22 absorbs the excessive pressing force. Under this condition, the pump 16 (FIGS. 1 and 2A–2C) operates to suck through the suction hole 27 formed in the cap 14, the communication hole 28 formed in the holder 20, and the tube 17, the ink remaining between the rectangular cavity of the cap 14 and the jet surface 11*a*.

Figure 6A:
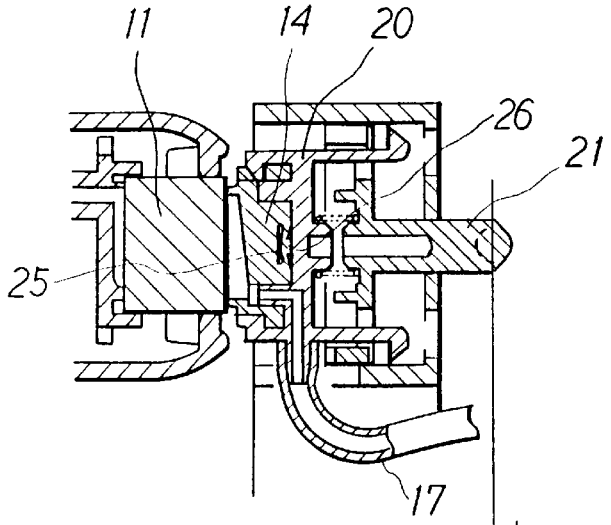
FIGS. 6A–6C are cross sections showing the capping device retracting from the jet surface.
Figure 6B:
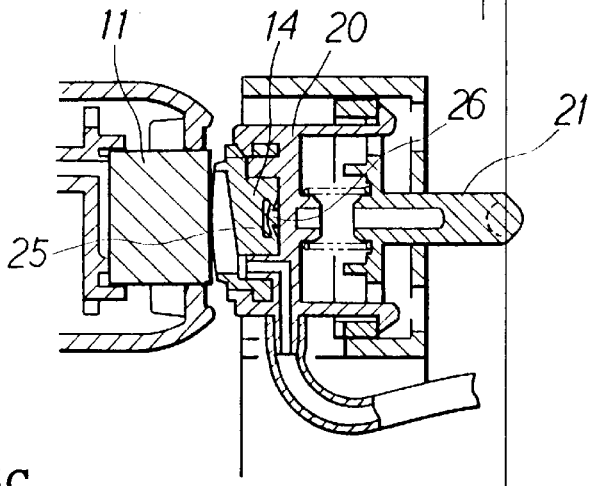

After the suction ends, the mover 21 starts to move from the position shown in FIG. 6A toward the retracted position. When, as shown in FIG. 6B, the rearward movement of the mover 21 eliminates the pressing force of the cap 14 on the jet surface 11*a*, restoring the cap grooves 25 (and 25') and brim 14*c* to their original shapes. As a result, the cap 14 is released from the surface 11*a* gradually from its upper and lower ends. Air flows through the thus formed upper and lower gaps into the space between the surface 11*a* and the cap 14. This prevents entrainment of air into the jet orifices of the head 11 due to residual negative pressure, thereby preventing defective or failed discharge of ink.

Figure 6C:
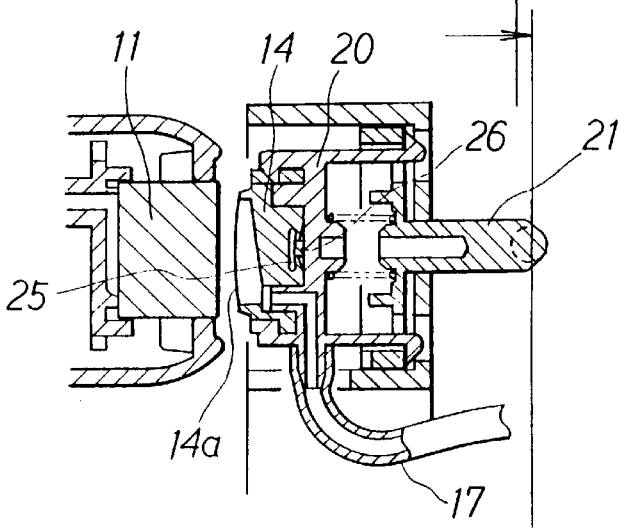
Figure 7:
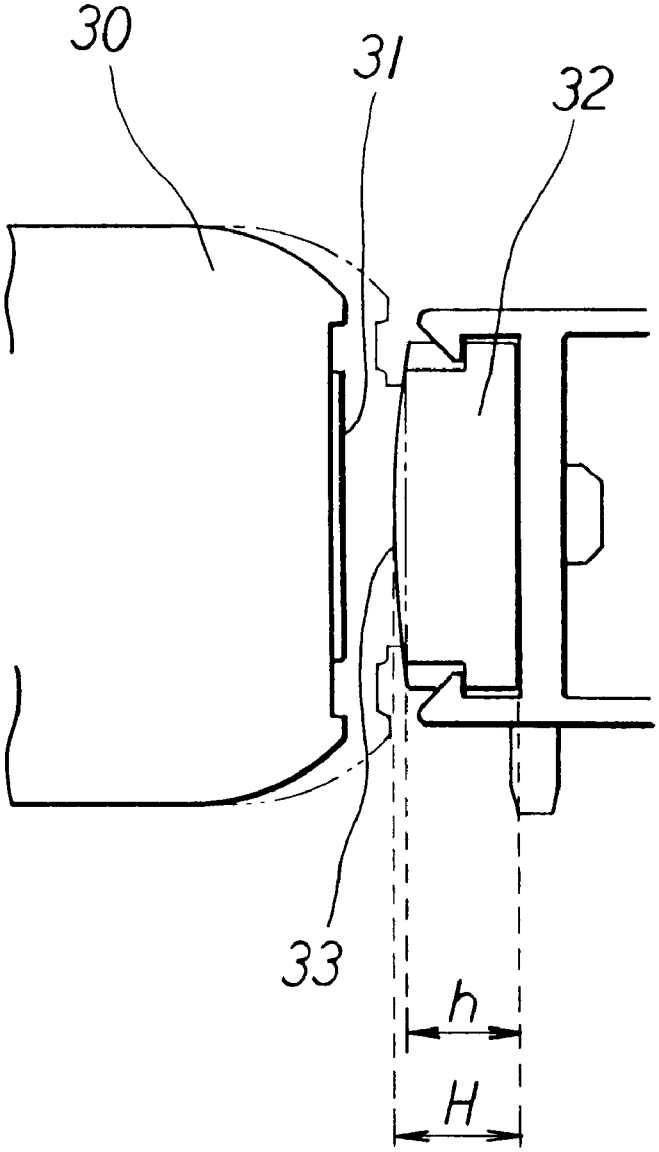
FIG. 7 PRIOR ART
FIG. 7 is a side view showing the capping device of a conventional ink jet head recovery apparatus.

As shown in FIG. 6C, further rearward movement of the mover 21 separates the cap 14 from the head 11, and returns the mover to the retracted position.

The invention is not limited to the embodiment. The protrusions 26 and 26' might be formed integrally on the holding surface 20*a* of the holder 20, not on the cap 14. Otherwise, in place of the integral protrusions 26 and 26', separate members might be fixed to the holding surface 20*a*.

The cap grooves 25 and 25' might be replaced with cavities of another shape. The cavities may be shaped like a new moon, a zigzag, a curve or an oval as seen from the side surfaces 14*d* and 14*d'* of the cap 14. Such cavities might be filled with members which are softer, more contractible, or more elastic than the cap 14. Otherwise, the portions of the cap 14 where such cavities are formed might be made of material which is softer, more contractible, or more elastic than the remainder of the cap. Such material is easily crushed or smashed when the cap 14 is pressed against the jet surface 11*a*. Therefore, the cap brim 14*c* can come in close contact with the surface 11*a* with smaller pressing force.

The positions of the cap protrusions 26 and 26' are not limited to both lateral ends of the cap bottom 14*b*. By positioning the protrusions 26 and 26' at the lateral ends, however, it is possible to make the longitudinal middle of the cap brim 14*c* high substantially uniformly on both sides of the cap 14.

In this embodiment, the invention is applied to a capping device and a recovery apparatus for a monochrome ink jet printer, which includes an ink jet head with a single jet nozzle. However, the invention is not limited to this, but may also be applied to recovery apparatus for color ink jet heads each including a number of jet nozzles. In such cases, a mechanism for moving a cap may be provided for each nozzle. Alternatively, a single mechanism may be provided for moving a plurality of caps, which are connected to a pump. In this case, each of the nozzles can be moved to the cap position, where the ink is sucked, so that each of the caps can prevent one of the nozzles from drying.

The capping device of the invention can be used for a recovery apparatus as described above, but the use of it is not limited to this. The capping device might be used to always prevent an ink jet nozzle from drying and foreign matter from entering the nozzle.

What is claimed is:

1. An ink jet capping device comprising:

a cap having a brim for covering an ink jet surface of an ink jet head, the cap being made of elastic material; and a holder for holding the cap;

wherein when the cap is held by the holder, a middle of the cap brim elastically deforms to protrude toward the ink jet surface and, when the cap held by the holder is pressed against the ink jet surface, the cap brim elastically deforms to become flat and cover the ink jet surface completely.

2. The ink jet head capping device of claim 1, wherein the cap has at least one of a cavity formed therein and a portion made of a contractible material, and when the cap is pressed against the ink jet surface, the cap deforms so that the cap brim becomes substantially straight to cover the ink jet surface completely.

3. The ink jet head capping device of claim 1, wherein the ink jet head has a row of nozzles formed therein with their front ends in the jet surface;

the cap being a long member extending along the nozzle row, the cap having a cavity formed therein at least in a longitudinal middle thereof;

the holder having a holding surface for contact with the back of the cap and an engaging part for such engagement with the cap that the cap back is in contact with the holding surface;

the capping device further comprising a protrusion positioned between the cap back and the holding surface for making the longitudinal middle of the cap back higher than the longitudinal end portions of the cap back when the cap back is in contact with the holding surface.

4. The ink jet head capping device of claim 3, wherein the cap deforms elastically in such a manner that, when the cap is held on the holder by the engaging part of the holder, the contact of the protrusion and the cap back or the holding surface with each other protrudes the longitudinal middle of the cap brim forward and, when the brim of the cap held by the holder is pressed against the jet surface, a collapse of the cavity causes the cap brim to cover the jet surface completely.

5. The ink jet head capping device of claim 3, wherein the protrusion is formed integrally with the cap.

6. The ink jet head capping device of claim 3, wherein the protrusion is formed integrally with the holder.

7. The ink jet head capping device of claim 1, wherein the ink jet head has a row of nozzles formed therein with their front ends in the jet surface;

the cap being a long member extending along the nozzle row, the cap having a pair of cavities formed therein at both lateral ends thereof at least in a longitudinal middle thereof;

the holder having a holding surface for contact with the back of the cap and an engaging part for such engagement with the cap that the cap back is in contact with the holding surface;

the capping device further comprising a pair of protrusions formed on both lateral ends of the cap back for making the longitudinal middle of the cap back higher than the longitudinal end portions of the cap back when the cap back is in contact with the holding surface.

8. The ink jet head capping device of claim 1, wherein the ink jet head has a row of nozzles formed therein with their front ends in the jet surface;

the cap being a long member extending along the nozzle row, at least a longitudinally middle part of the cap being made of a contractible material;

the holder having a holding surface for contact with the back of the cap and an engaging part for such engagement with the cap that the cap back is in contact with the holding surface;

the capping device further comprising a protrusion positioned between the cap back and the holding surface for making the longitudinal middle of the cap back higher than the longitudinal end portions of the cap back when the cap back is in contact with the holding surface.

9. The ink jet head capping device of claim 8, wherein the cap deforms elastically in such a manner that, when the cap is held on the holder by the engaging part of the holder, the contact of the protrusion and the cap back or the holding surface with each other protrudes the longitudinal middle of the cap brim forward and, when the brim of the cap held by the holder is pressed against the jet surface, deformation of the contractible material causes the cap brim to cover the jet surface completely.

10. The ink jet head capping device of claim 8, wherein the protrusion is formed integrally with the cap.

11. The ink jet head capping device of claim 8, wherein the protrusion is formed integrally with the holder.

12. The ink jet head capping device of claim 1, wherein the ink jet head has a row of nozzles formed therein with their front ends in the jet surface;

the cap being a long member extending along the nozzle row, the cap including a pair of lateral end parts formed at least in a longitudinal middle thereof, the end parts being made of a contractible material;

the holder having a holding surface for contact with the back of the cap and an engaging part for such engagement with the cap that the cap back is in contact with the holding surface;

the capping device further comprising a pair of protrusions formed on both lateral ends of the cap back for making the longitudinal middle of the cap back higher than the longitudinal end portions of the cap back when the cap back is in contact with the holding surface.

13. The ink jet head capping device of claim 1, further comprising a suction pump connected to the cap for sucking the jet surface of the ink jet head so as to recover the head.

14. The ink jet head capping device of claim 1, further comprising a protrusion positioned between a back of the cap and a cap holding surface of the holder to make a longitudinal middle portion of the back higher than longitudinal end portions of the back when the back is in contact with the holding surface.

15. An ink jet printer comprising:

a carriage for moving along a surface of a printing sheet;

an ink jet head carried by the carriage; and a capping device including a cap made of an elastic material, the cap having a brim for covering an ink jet surface of the ink jet head, and a holder for holding the cap;

wherein when the cap is held by the holder, a middle of the cap brim elastically deforms to protrude toward the ink jet surface and, when the cap held by the holder is pressed against the ink jet surface, the cap brim elastically deforms to become flat and cover the ink jet surface completely.

16. The ink jet printer of claim 15, wherein the cap has either one of a cavity formed therein and a portion made of a contractible material, and when the cap is pressed against the ink jet surface, the cap deforms so that the cap brim becomes substantially straight to cover the ink jet surface completely.

17. The ink jet printer of claim 16, wherein the cavity is formed in a shape of groove.

18. The ink jet printer of claim 15, wherein the ink jet head has a row of nozzles formed therein with their front ends in the jet surface;

the cap being a long member extending along the nozzle row, the cap having a cavity formed therein at least in a longitudinal middle thereof;

the holder having a holding surface for contact with the back of the cap and an engaging part for such engagement with the cap that the cap back is in contact with the holding surface;

the capping device further comprising a protrusion positioned between the cap back and the holding surface for making the longitudinal middle of the cap back higher than the longitudinal end portions of the cap back when the cap back is in contact with the holding surface.

19. The ink jet printer of claim 18, wherein the cap deforms elastically in such a manner that, when the cap is held on the holder by the engaging part of the holder, the contact of the protrusion and the cap back or the holding surface with each other protrudes the longitudinal middle of the cap brim forward and, when the brim of the cap held by the holder is pressed against the jet surface, collapse of the cavity causes the cap brim to cover the jet surface completely.

20. The ink jet printer of claim 18, wherein the protrusion is formed integrally with the cap.

21. The ink jet printer of claim 15, wherein the ink jet head has a row of nozzles formed therein with their front ends in the jet surface;

the cap being a long member extending along the nozzle row, at least a longitudinally middle part of the cap being made of a contractible material;

the holder having a holding surface for contact with the back of the cap and an engaging part for such engagement with the cap that the cap back is in contact with the holding surface;

the capping device further comprising a protrusion positioned between the cap back and the holding surface for making the longitudinal middle of the cap back higher than the longitudinal end portions of the cap back when the cap back is in contact with the holding surface.

22. The ink jet printer of claim 21, wherein the cap deforms elastically in such a manner that, when the cap is held on the holder by the engaging part of the holder, the contact of the protrusion and the cap back or the holding surface with each other protrudes the longitudinal middle of the cap brim forward and, when the brim of the cap held by the holder is pressed against the jet surface, deformation of the contractible material causes the cap brim to cover the jet surface completely.

23. The ink jet printer of claim 21, wherein the protrusion is formed integrally with the cap.

24. The ink jet printer of claim 15, further comprising a suction pump connected to the cap for sucking the jet surface of the ink jet head so as to recover the head.

25. The ink jet printer of claim 15, further comprising a protrusion positioned between a back of the cap and a cap holding surface of the holder to make a longitudinal middle portion of the back higher than longitudinal end portions of the back when the back is in contact with the holding surface.

* * * * *